United States Patent [19]

Maurer

[11] Patent Number: 4,772,232

[45] Date of Patent: Sep. 20, 1988

[54] LAMP HOLDING DEVICE

[76] Inventor: Ingo Maurer, Kaiserstrasse 47, 8000 Muenchen 40, Fed. Rep. of Germany

[21] Appl. No.: 913,673

[22] PCT Filed: Dec. 27, 1985

[86] PCT No.: PCT/EP85/00743

§ 371 Date: Sep. 15, 1986

§ 102(e) Date: Sep. 15, 1986

[87] PCT Pub. No.: WO86/04458

PCT Pub. Date: Jul. 31, 1986

[30] Foreign Application Priority Data

Jan. 15, 1985 [DE] Fed. Rep. of Germany ..... 3501131

[51] Int. Cl.[4] ..... H01R 13/05

[52] U.S. Cl. ..... 439/817

[58] Field of Search ..... 439/110–115, 439/120, 121, 209–211, 817, 818

[56] References Cited

U.S. PATENT DOCUMENTS 2,732,534 1/1956 Giel ..... 439/817

*Primary Examiner*—Joseph H. McGlynn

*Attorney, Agent, or Firm*—Birch, Stewart, Kolasch & Birch

[57] ABSTRACT

The lamp holding device consists of a tubular electrically insulating sleeve with two bores extending transversally to the longitudinal axis of the sleeve, for receiving contact pins of a bulb, and two end pieces fixed to the ends of the sleeve, with electrically conducting clips extending into the sleeve up to the bores for receiving the contact pins. The electric lead-in wires are fixed to the end pieces and the end pieces lead the electric current from the connecting wires to the clips being in contact with the contact pins.

4 Claims, 2 Drawing Sheets

LAMP HOLDING DEVICE

BACKGROUND OF THE INVENTION

1. Field of the Invention

The invention relates to a lamp holding device for low-voltage lamps.

2. Description of Related Art

The design of modern lamps on one hand requires that the lamps due to their function characteristics fulfill the requirements of good lighting sources and on the other hand be aimed at making the individual parts of the lamp as simple as possible and with as few accessories as necessary. Therein the function of the individual parts of the lamp remain recognizable, but the lamp parts themselves are designed according to the principles of modern design. In this design of lamps the holding device thereof up to now has been the critical point as the traditional lamp sockets are looked upon as inconvenient if they are not provided with suitably formed covers. Such covers or housings, however, add up to the lamp socket itself, such enlargement being undesired when the entire lamp is to be kept small.

The present invention, therefore, is based on the problem of creating a multi-functional holding device which is small as a whole and applicable to lamps, in particular to lamps having a modern design, without the lamp casing.

SUMMARY OF THE INVENTION

To solve this problem the lamp holding device according to the present invention, for low-voltage lamps, is characterized in a manner according to the main claim. The lamp holding device basically looks like a stick or a tube whereas the inner arrangement of the lamp holding device cannot be seen from the outside. When the lamp is inserted into the lamp holding device, the result is a solution being characterized by simplicity and elegance and simultaneously being technically completely functional. The lamp holding device itself can be kept extremely small. In a practical embodiment of the lamp holding device the constructional height of the sleeve including the end pieces is only approximately 30 mm. This low constructional height is obtained because the contact members fulfill two functions, namely on one hand the power supply and on the other hand the mechanical support of the lamp.

Another embodiment of the present invention has the advantage that the lamp can be easily pivoted around the longitudinal axis of the lamp holding device and fixed in each respective position.

The preferred embodiment of the lamp holding device of the invention provides an extremely simple way of supplying power to the end pieces and thus through the clips to the contact pins of the lamp.

Still another embodiment of the lamp holding device of the invention has the advantage that the lead-in wires can be inserted into the end pieces both perpendicularly from the the top and from the side in the longitudinal direction thereof. Inserting the lead-in wires perpendicularly from the top into the lamp holding device is particularly suitable in suspended lamps.

A further embodiment of the lamp holding device of the invention represents an advantageous solution for the connecting system as the metallic end piece itself has the function of the connecting means.

A still further embodiment of the lamp holding device of the invention relates to a further modification of the end piece. Therein, the end piece has a cap in which the connecting member is arranged. By means of the cap it is possible to match the outer form of the end piece with respect to the appearance of the sleeve of the holding device in favorable manner and it is also possible to fix the lead-in wire to the end piece in simplified manner.

Another embodiment of the lamp holding device has the advantage that the lead-in wire can be fixed in the end piece in simple manner.

Another embodiment of the lamp holding device has the advantage that the end piece may easily be fixed to the sleeve, using only a few manual operations.

BRIEF DESCRIPTION OF THE DRAWINGS

Embodiments of the invention are now explained using the enclosed drawings, in which.

DETAILED DESCRIPTION OF PREFERRED EMBODIMENTS

Figure 1:
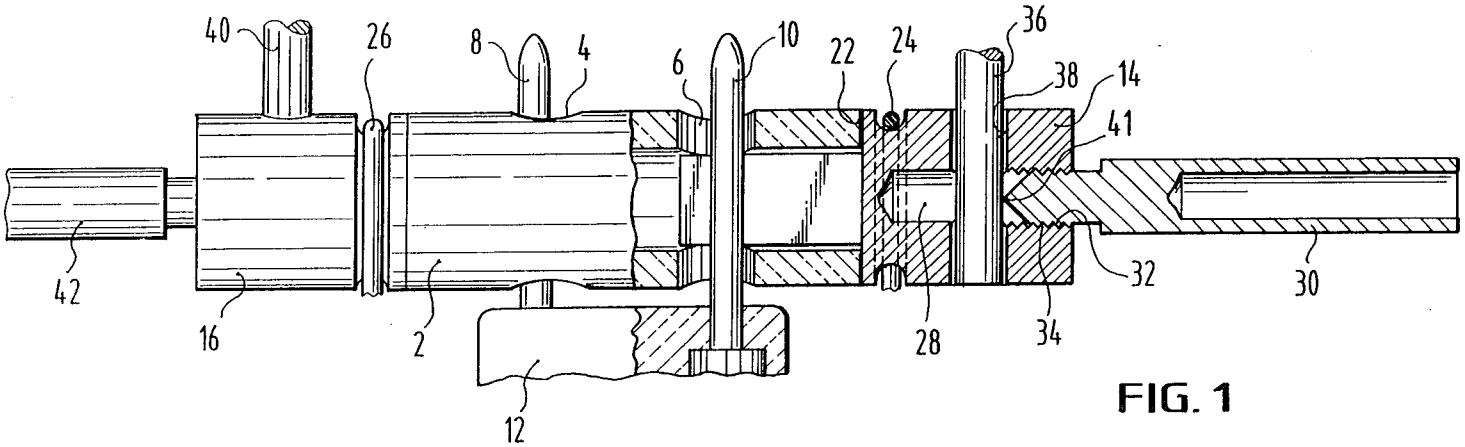
FIG. 1 is a side view of the lamp holding device, partly in section and partly in top view.

According to FIG. 1 the lamp holding device includes a tubular electrically insulating sleeve 2 out of ceramic material with two bores 4, 6 extending transversely to the longitudinal axis of the sleeve 2, for receiving contact pins 8, 10 of a bulb 12 or a socket. The partly shown bulb 12 of FIG. 1 is a halogen lamp. The lamp holding device further includes two end pieces 14, 16 each having electrically conducting clips 18, 20 which in an assembled state of the lamp holding device extend into the sleeve 2 up to the bores 4, 6 for receiving the contact pins 8, 10. The clips 18, 20 embrace the contact pins 8, 10 and thus, on one hand, form an electric lead to the bulb 12 and, on the other hand, hold the bulb in the lamp holding device.

As is shown in FIG. 1 at 22, the end piece 14 is cemented with the sleeve 2 for obtaining a secure fixture between the end piece and the sleeve. Supporting wires 24, 26 are additionally provided at the end pieces 14, 16. With the aid of the supporting wires, a lamp-shade may be fixed to the holding device.

Figure 2:
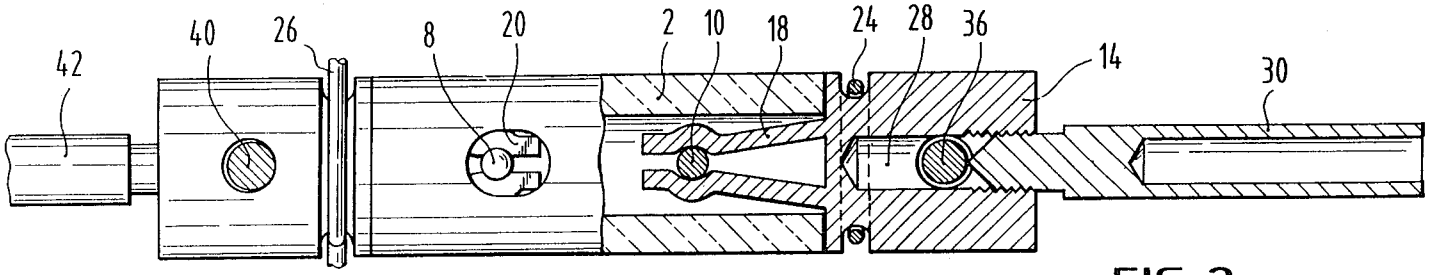
FIG. 2 is a further side view of the lamp holding device, partly in section and partly in top view, the sectional view being shifted by 90° with respect to the sectional view of FIG. 1.

According to FIGS. 1 and 2 the end pieces 14, 16 have the same outer dimensions as the sleeve 2. This results in a uniform appearance of the lamp holding device so that no cover is necessary for imparting a respectable appearance to the lamp holding device usually to be seen from the outside.

The connecting means required to provide a power supply to the bulb 12 has a longitudinal bore 28 in the end piece 14 and a bushing 30 which can be screwed by means by a male thread 32 into a female thread 34 provided in the longitudinal bore 28. An electric wire (not shown) can be inserted into the bushing 30 as a lead-in means. As can be seen from FIGS. 1 and 2, the current is supplied through a wire 36 inserted into a further bore 38 of the end piece 14. The bore 38 extends transversally to the longitudinal axis of the end piece 14 and thus intersects the bore 28. Wire 36 is introduced into and clamped in the bore 38 by the bushing 30 being screwed into the bore 28 until a point 41 of the bushing 30 comes into contact with the wire 36 and clamps the latter. The embodiment shown in FIG. 1, of the connecting member is only one possibility for fixing a lead-in wire. It would also be possible to introduce a lead-in wire into the bore 28 and fix it with the aid of the bushing 30 when the bushing is screwed in the bore 38. It is also possible to use a clamping screw instead of the bushing 30. When the bushing 30 itself is used as terminal for a wire, the wire 36, of course, can be omitted.

The lamp holding device is completed by an electrically conducting connecting system providing a conducting connection between the bushing 30 and/or the wire 36 with the clip 18. According to FIG. 1 the connecting system is realized in that the end piece 14 itself is made of an electrically conducting material. It is, however, also possible to form the end piece 14 out of two parts, wherein a metal bushing is arranged at the circumference of the bore 28, which bushing is connected to the clip 18, whereas the shell of the piece 14 consists of a non-conducting material.

The end piece 16 is formed identical to the end piece 14, wherein only the connecting wire 40 and the bushing 42 (partly cut) are shown in FIGS. 1 and 2.

Figure 3:
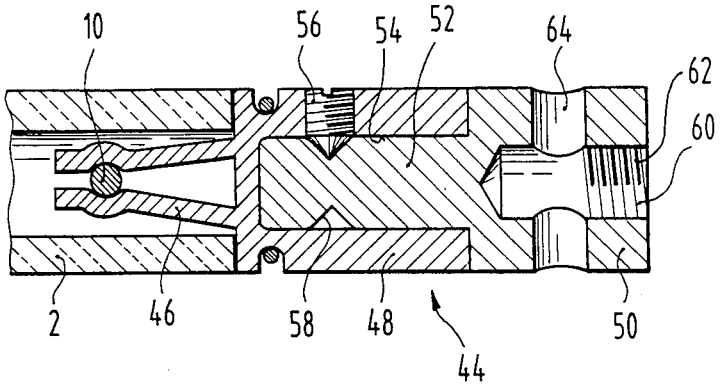
FIG. 3 is a cross-section through one end of a lamp holding device, wherein another embodiment of the end piece is shown.

In FIG. 3 is a modified embodiment of an end piece 44 is shown, consisting of a supporting member 48 being connected to the sleeve 2 and having a clip 46 and an additional member 50 being rotatably supported in the supporting member 48 and being lockable therein, the additional member 50 containing the connecting system. For supporting the two parts in relation to one another the additional member 50 has a supporting pin 52 and the supporting member 48 includes a longitudinal bore 54 receiving the supporting pin 52. The fixing means for securing the additional member 50 in the supporting member 48 includes a transversal screw 56 in the supporting member 48 and a groove 58 arranged at the pin 52 of the additional member 50, into which groove the transversal screw 56 may be screwed in. When the transversal screw 56 is screwed in, the additional member 50 may pivot in the supporting member 48, both parts being secured against shifting along their common longitudinal axis. The additional member 50 has a longitudinal bore 60 with a female thread 62, into which a bushing may be screwed, the bushing corresponding to the bushing 30 of the embodiment if FIG. 1. Furthermore, the additional member 50 has a bore 64 extending transverse to the bore 60, the bore 64 corresponding to the bore 38 in the embodiment of FIG. 1 and being adapted for receiving a wire corresponding to the wire 36. Apart therefrom the lamp holding device with the end piece 44 is constructed in such manner as is shown in the FIGS. 1 and 2. The end piece 44 allows a pivoting movement of the lamp mounted in the lamp holding device around the longitudinal axis of the lamp holding device with most simple measures in spite of the small dimensions of the lamp holding device.

Figure 4:
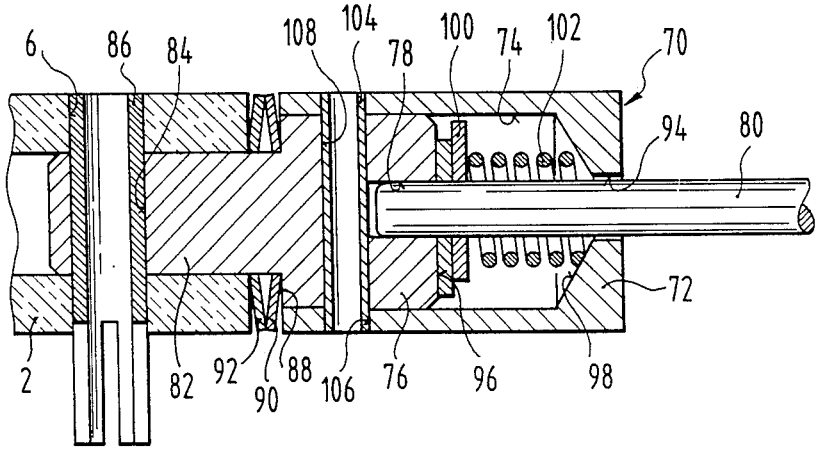
FIG. 4 is a cross-section through one end of a lamp holding device, wherein a further embodiment of the end piece is shown.

FIG. 4 shows a further modified embodiment of an end piece 70 having a hollow-cylindrically shaped cap 72 in the inner bore 74 of which a connecting member 76 is fixed. The connecting member 76 is fitted into the inner bore 74 of the cap 72 and has a bore 78 intended as a receiving aperture for the end of a lead-in wire 80. The connecting member further includes a contact member in the form of a pin 82 fitted into the bore of the sleeve 2 and extending further than the bore 6 in the sleeve 2, which bore receives the contact pin of the bulb. The pin 82 has a bore 84 in line with the bore 6. Into both bores 6, 84 a contact sleeve 86 is inserted, for receiving the contact pin of the bulb and for creating the electric connection between the pin 82 and the contact pin of the bulb. The contact sleeve 86 furthermore serves to secure the connecting member 76 in the sleeve 2. Two plate springs 19, 92 are disposed between the end of the sleeve 2 and a shoulder 88 of the connecting member 76, the outer circumference of which is in line with the outer circumference of the sleeve 2. The plate springs keep the connection between the connecting member 76 and the sleeve 2 under tension.

The cap 72 has a bore 94 formed opposite to the bore 78 in the connecting member 76, through which bore 94 the lead-in wire 80 is led to the connecting member 76 through the cap 72. In the interior of the cap 72 between the front face 96 of the connecting member 76 and the inner wall 98 of the cap 72 lying opposite to the front face of the connecting member 76 there are arranged a retaining ring 100 adjacent to the connecting member 76 and a compression spring 102 disposed between the retaining ring 100 and the inner wall 98 of the cap 72. The retaining ring 100 holds the lead-in wire 80 in the bore 78 of the connecting member 76. The compression spring 102 presses the retaining ring 100 to the front face 96 of the connecting member 76. A hollow retaining pin 104 inserted into a cross bore 106 of the cap 72 and into a bore 108 in line therewith, of the connecting member 76 serves to secure the cap 72 on the connecting member 76. During assembly of the end piece at first the connecting member 76 is inserted into the sleeve 2 therein introducing the plate spring 90, 92 and is secured by means of the contact sleeve 86. Then, the lead-in wire 80 is inserted into the cap 72 through the bore 94, and the compression spring 102 and the retaining ring 100 are mounted onto the lead-in wire 80. Then, the lead-in wire is inserted into the bore 78 of the connecting member 86 and the cap 72 is fixed to the connecting member 76 by means of the retaining pin 104.

The invention being thus described, it will be obvious that the same my be varied in many ways. Such variations are not to be regarded as a departure from the spirit and scope of the invention, and all such modifications as would be obvious to one skilled in the art are intended to be included within the scope of the following claims.

I claim:

1. A lamp holding device for low-voltage lamps, comprising:

(a) a tubular electrically insulating sleeve with two bores extending transverse to the longitudinal axis of the sleeve for receiving contact pins of a bulb or a socket; and (b) two end pieces fixed to the ends of the sleeve, which end pieces include:

electrically conducting contact members extending into said sleeve up to said bores for receiving said contact pins and supporting said bulb or socket, said contact members supplying power to said contact pins and mechanically fixed said end pieces to the ends of said sleeve;

connecting members insertable into said end pieces, each for one electric lead-in wire; and means for electrically connecting the connecting members and the conducting contact members.

2. The lamp holding device according to claim 1, wherein said means for electrically connecting includes intersecting bores formed in said end piece and a bushing insertable therein.

3. The lamp holding device according to claim 1, wherein said means for electrically connecting has a first bore formed on the longitudinal axis of the end piece, a second bore formed transverse to the longitudinal axis of said end piece, and a bushing insertable in said first bore, by means of which bushing a connecting wire insertable into said second bore can be fixed.

4. The lamp holding device according to claim 1, wherein said end pieces are made of electrically conducting material.

* * * * *